US005290063A

United States Patent [19]

Lenhart

[11] Patent Number: 5,290,063

[45] Date of Patent: Mar. 1, 1994

[54] HAND GRIP CONSTRUCTION FOR A SKI POLE OR THE LIKE

[76] Inventor: Klaus Lenhart, Jesinger Strasse 84, D-7312 Kirchheim (Teck), Fed. Rep. of Germany

[21] Appl. No.: 862,575

[22] PCT Filed: Nov. 2, 1991

[86] PCT No.: PCT/DE91/00865

§ 371 Date: Jun. 25, 1992

§ 102(e) Date: Jun. 25, 1992

[87] PCT Pub. No.: WO92/10250

PCT Pub. Date: Jun. 25, 1992

[30] Foreign Application Priority Data

Dec. 4, 1990 [DE] Fed. Rep. of Germany ..... 4038598

[51] Int. Cl.[5] ..... A63C 11/22

[52] U.S. Cl. ..... 280/821; 135/76; 16/DIG. 12

[58] Field of Search ..... 280/610, 819, 821, 822; 135/72, 76; 16/114 R, DIG. 12, DIG. 19

[56] References Cited

U.S. PATENT DOCUMENTS

| | | | |
|---|---|---|---|
| 3,565,451 | 2/1971 | Giambazi | 280/821 |
| 3,567,237 | 3/1971 | Miller, III | 280/610 |
| 4,337,963 | 7/1982 | Stevenson | 280/610 X |
| 4,712,304 | 12/1987 | Sanelli | 16/DIG. 19 X |
| 4,934,024 | 6/1990 | Sexton, I | 16/DIG. 12 X |
| 4,949,457 | 8/1990 | Burout, III | 16/DIG. 19 X |

FOREIGN PATENT DOCUMENTS

| | | |
|---|---|---|
| 2007748 | 9/1970 | Fed. Rep. of Germany . |
| 2229116 | 1/1974 | Fed. Rep. of Germany . |
| 8300930 | 6/1983 | Fed. Rep. of Germany . |
| 55-972 | 1/1980 | Japan . |
| 58-76243 | 5/1983 | Japan . |
| 1-123562 | 8/1989 | Japan . |
| 2023506 | 1/1980 | United Kingdom . |
| 2184012 | 6/1987 | United Kingdom . |
| 2209495 | 5/1989 | United Kingdom . |

*Primary Examiner*—Brian L. Johnson

*Attorney, Agent, or Firm*—Sommer, Oliverio & Sommer

[57] ABSTRACT

An improved handle (14) for a walking stick or ski pole additionally serves as a vehicle for advertising. The improved handle has an inner part (26) and an outer part (28). The two parts are formed of different materials. Portions (18,20,22,24) of the inner part project outwardly through openings in the outer part, and are visible from the outside of the handle. The inner and outer parts are made of different materials.

6 Claims, 3 Drawing Sheets

HAND GRIP CONSTRUCTION FOR A SKI POLE OR THE LIKE

TECHNICAL FIELD

The present invention relates generally to an improved handle or hand grip construction, such as for use with a ski pole, walking stick or the like. The improved hand grip includes an inner shaped tubular part and includes an outer shaped tubular part surrounding the inner part. The inner part has projections which extend through openings provided in the outer part so that the distal ends of the projections made be seen from a distance. The inner part has a blind axial recess arranged to receive and accommodate a marginal end portion of a shaft, such as a ski pole, walking stick and the like.

BACKGROUND ART

Handles or hand grips for ski poles, walking sticks, and the like, are of course known. Some of these are shown in published German Patent Application No. 22 29 116, and in German Utility Model No. 83 00 930. These references teach that such a handle may be used for advertising purposes. Trademarks are similar informative details may be sprayed on, or otherwise adhere to the surface of the handle in a suitable contrasting color.

The intensive wear that such handles are subjected to offend causes the color to become unsightly, or to be rubbed off completed within a relative short period of time.

The object of the present invention is to provide an improved handle for a ski pole, walking stick, or the like, which handle offers the possibility of displaying design information on its outer surface in a manner that is resistant to wear.

This object is accomplished by providing an inner shaped tubular portion, and an outer shaped tubular portion surrounding the inner portion. The outer portion has various through holes communicating its inner and outer surfaces. The inner part has raised indica, which intend through the outer part opening so as to be visible from without the handle.

The inner shaped part thus contributes toward forming the outer surface of the assembled handle. The inner part, or at least the raised portions thereof, may be, and preferably are, in a color contrasting to that of the outer part, so that the visible raised portions will be in a contrasting color.

The outer part may have a somewhat oval shape, with the informative indica being formed on at least one of its two longitudinal sides.

The projecting portions of the inner part may have their distal ends arranged to be flush with the outer surface of the outer part, or may have their distal ends recessed relative to the outer surface of the outer part.

The inner part projections may be symbol-, relief- and/or letter-type design, depending, for example, on the nature of the informative information to be conveyed.

In a preferred embodiment, the inner part is injection molded, and is encased by the outer part in order to prevent shifting of the outer part during its application. The inner and/or outer parts may have additional interlocking projections and recesses to prevent relative movement of the inner and outer parts. These interlocking projections and recesses need not necessarily penetrate the outer part.

The inner part is preferably formed of a hard plastic, such as a polyamide. The outer part is preferably formed of a material which defers from that of the inner part. The outer part may, for example, be formed of an elastomer, which affords the capability of a non-slip handle outer surface.

The handle is preferably designed as a separate commercial article. The handle is then pushed on to the marginal end portion of the walking stick, ski pole or the like, and is subsequently affixed to it.

SUMMARY OF THE INVENTION

The present invention provides am improved handle (14) for a shaft (12), which includes a tubular inner part (26) having an inner surface adapted to face a portion of the shaft, having an outer surface, and having a projection (18, 20, 22 or 24) extending away from the inner part outer surface and terminating in a distal end surface; a tubular outer part (28) adapted to surround the inner part, the outer part having an inner surface adapted to face toward the inner part outer surface, having an outer surface adapted to be grasped and having a through opening extending between the outer part inner and outer surfaces, the opening being adapted to receive the projection; whereby the projection distal end surface will be visible from outside the handle.

Accordingly, the general object of the invention is to provide an improved handle for a shaft, which affords the capability of providing contrasting colors for display of advertising material.

These and other objects and advantages will become apparent from the foregoing and ongoing written specification, the drawings, and the appended claims.

DESCRIPTION OF THE PREFERRED EMBODIMENTS

Figure 1:
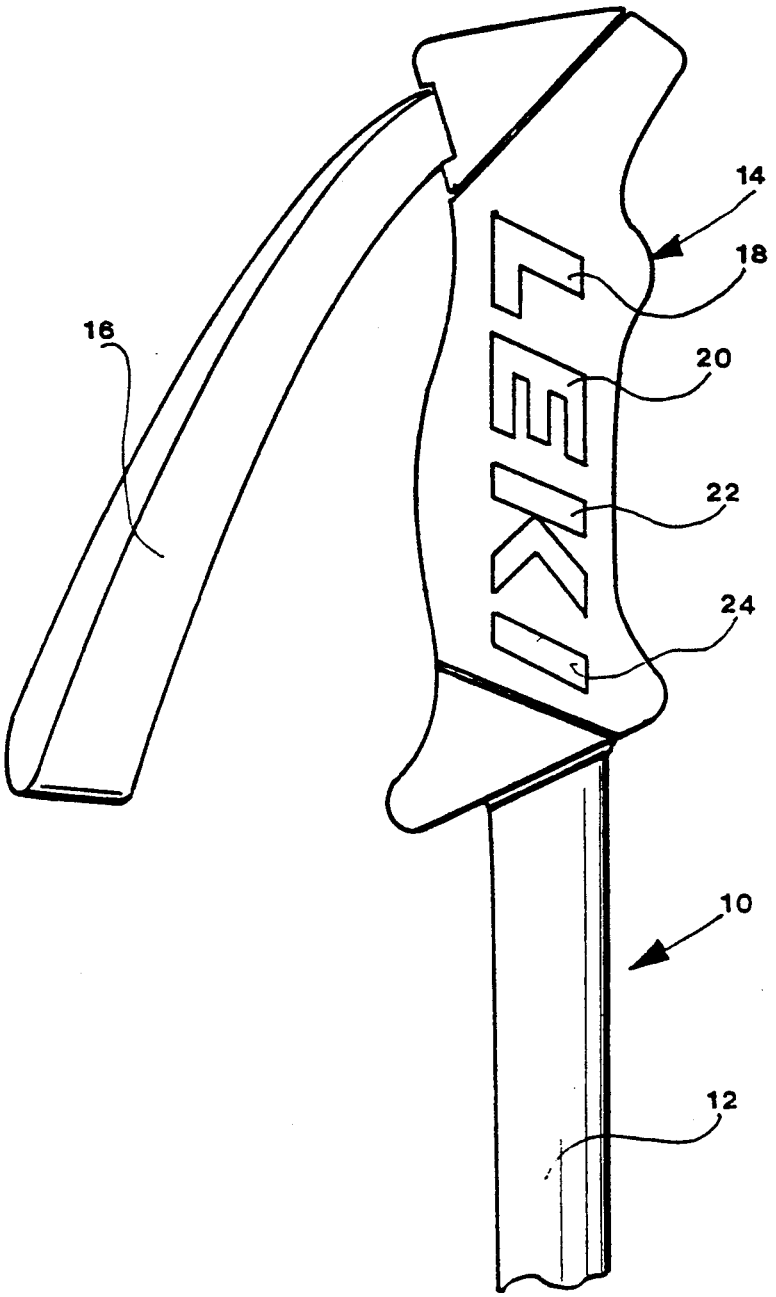
FIG. 1 is a fragmentary side elevation of a ski pole incorporating the improved handle.

At the outset, it should be clearly understood that life reference numerals are intended to identify the same structural elements, portions or surfaces consistently throughout the several drawings figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

The upper end of a ski pole or walking stick is designated at 10 in FIG. 1. The pole or stick is formed by a suitable metal tube 12 carrying a handle, generally indicated at 14, on its upper marginal end portion. A strap 16 is secured to the upper marginal end portion of the handle. The outer shape of handle 14 is known.

Accordingly to the present invention, however, handle 14 additionally serves to provide a means of advertising. For this purpose, the handle has two opposite longitudinal sides on which visible symbols 18,20,22 and 24, for example, appear. In the illustrated form, these symbols are in the form of letters, but could be some other form of indica. The color of symbols 18,20,22 and 24 contrast with the color of handle 14, and may be luminous. The design according to the present invention is particularly effective for advertising purposes, and is also characterized by resistance to wear and color fidelity. Symbols 18–24 may also be of different colors.

The resistance to wear and color stability of symbols 18–24 is achieved by the symbols being formed of a different material from that of the surface of the handle 14. Handle 14 consists of two parts, namely, an inner shaped tubular part 26 and an outer shaped covering or part 28 which surrounds and encloses the entire surface of inner part 26. Inner part 26 is preferably formed of a suitable plastic of high design strength, preferably polyamide, which has projections of corresponding design forming symbols 18–24 on its two longitudinal sides 30 and 32.

In contrast with the material of the inner part 26, the outer part 28 may be formed of an elastomer which is pleasant to grip and lies comfortably in one's hand. This elastomer is preferably based on a nature rubber, and does not cover symbols 18–24. In fact, the outer part has suitable openings through which symbols 18–24 extend so that the distal ends of these projections are substantially flush with the outer surface of outer part 28. In other words, the distal end faces of symbols 18–24 preferably terminate with, and are substantially flush with, the outer surface 34 of outer covering 28, and thus are clearly visible. Similar projections may extend outwardly from other portions of inner part 26. In other words, the projections need not necessarily extend outwardly from the two longitudinal sides of the inner part.

Figure 2:
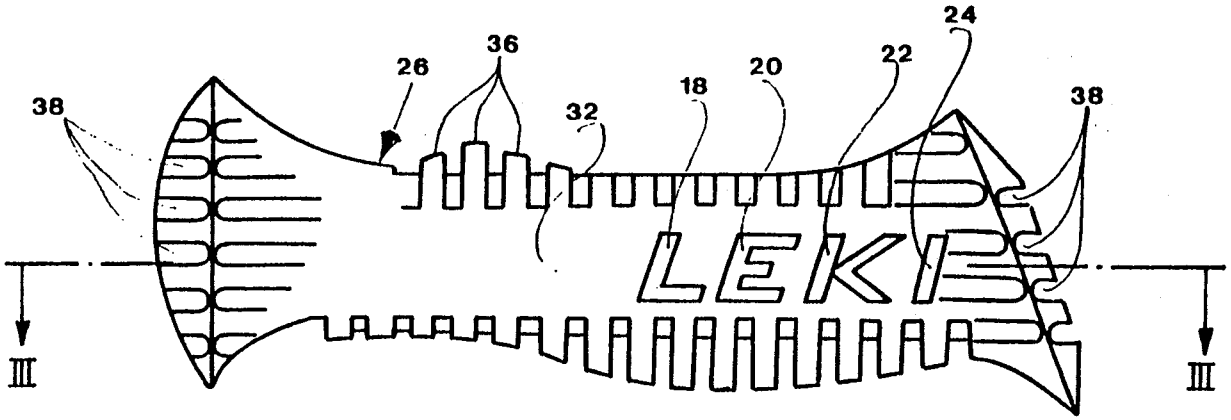
FIG. 2 is a side elevation of the shaped inner part, with the outer part removed.
Figure 3:
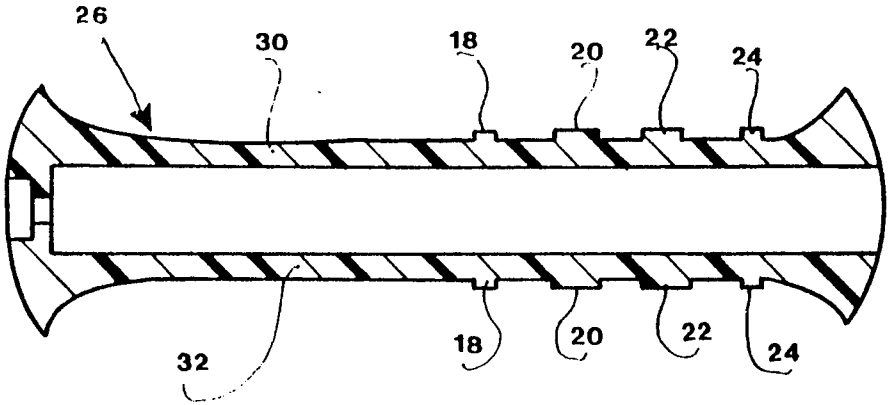
FIG. 3 is a fragmentary longitudinal sectional view thereof, taken on III—III of FIG. 2.
Figure 4:
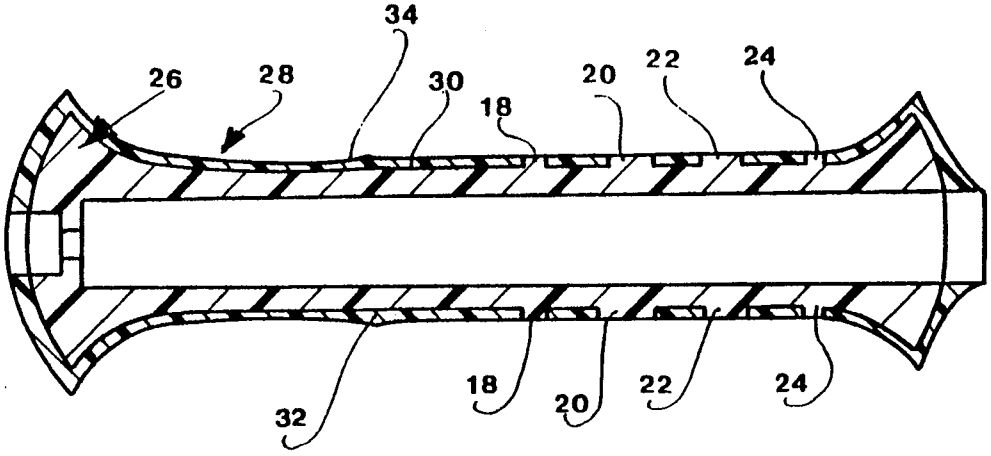
FIG. 4 is a longitudinal sectional view of the improved handle, showing the outer part as surrounding the inner part, but with the marginal end of the sticker pole removed.

As shown in FIG. 2 the outer part 28 has an outer surface including a plurality of further projections 36 and depressions 38 to provide the outer surface of the handle with a secure and stabilizing support to be grasped by a persons hand.

If the projections 18–24 are to be of different colors, correspondingly-dyed plastics are formed on the shaped part.

Therefore, while the preferred embodiment of the improved handle has been shown and described, and several modifications thereof discussed, persons skilled in this art will readily appreciate that various additional changes and modifications may be made without departing from the spirit of the invention, as defined and differentiated by the following claims.

What is claimed is:

1. A hand grip for a ski pole shaft, comprising:

a tubular inner part having an inner surface adapted to face and directly engage a portion of said shaft, having an outer surface, and having a plurality of projection means extending away from said inner part outer surface and terminating in distal end surfaces;

a tubular outer part adapted to surround said inner part, said outer part having an inner surface adapted to face toward and engage said inner part outer surface, having an outer surface including projections adapted to be grasped by a user, and having a plurality of through openings extending between said outer part inner and outer surfaces, said openings being adapted to receive said projection means; whereby said distal end surfaces are visible from the outside of said hand grip for information display purposes.

2. A hand grip as set forth in claim 1 wherein said distal end surfaces and said outer part have contrasting colors.

3. A hand grip as set forth in claim 2 wherein said inner part and said projection means are formed integrally.

4. A hand grip as set forth in claim 1 wherein said inner and outer parts are formed of different materials.

5. A hand grip as set forth in claim 1 wherein said inner part is formed of a relatively hard material, and said outer part is formed of a relatively soft elastomeric material.

6. A hand grip as set forth in claim 1 wherein said distal end surfaces are substantially continuous with a marginal portion of said outer part outer surface about said openings.

* * * * *